US005551499A

United States Patent [19]

McRoberts

[11] Patent Number: 5,551,499

[45] Date of Patent: Sep. 3, 1996

[54] SEAL ASSEMBLY FOR AN OPERABLE PARTITION

[75] Inventor: Jerald A. McRoberts, New Castle, Ind.

[73] Assignee: Modernfold, Incorporated, New Castle, Ind.

[21] Appl. No.: 272,692

[22] Filed: Jul. 8, 1994

[51] Int. Cl.[6] ..... E06B 7/18

[52] U.S. Cl. ..... 160/40; 49/483.1; 160/199

[58] Field of Search ..... 160/199, 206, 160/40; 49/411, 483.1; 52/71, 238.1, 64

[56] References Cited

U.S. PATENT DOCUMENTS

| | | | |
|---|---|---|---|
| 3,073,381 | 1/1963 | Burmeister | 160/40 |
| 3,295,257 | 1/1967 | Douglass | 160/40 |
| 3,755,968 | 9/1973 | Williams | 160/40 X |
| 4,073,092 | 2/1978 | Williams | 160/199 X |
| 5,042,555 | 8/1991 | Owens | 160/40 X |

FOREIGN PATENT DOCUMENTS

| | | | |
|---|---|---|---|
| 761743 | 2/1965 | Canada | 160/40 |
| 685966 | 12/1939 | Germany | 49/411 |
| 965721 | 6/1961 | United Kingdom | 160/40 |

OTHER PUBLICATIONS

OPMA/NSSEA, Sound Control Performance of Operable Partitions, 1993.

*Primary Examiner*—Blair Johnson
*Attorney, Agent, or Firm*—Baker & Daniels

[57] ABSTRACT

An operable partition seal assembly for use with an operable partition to provide an air-tight seal between the operable partition and a carpeted floor. The seal assembly includes a first sealing strip attached to an underside of an operable partition drop seal. The seal assembly also includes a second sealing strip installed in the carpeted floor beneath the operable partition when it is in a wall forming position. The second sealing strip includes a thin, upwardly extending sealing portion which is disposed within the carpet and which sealingly engages the first sealing strip to provide a sound barrier seal. The second sealing strip also preferably includes a mechanism for retaining the upwardly extending sealing portion in an operational alignment.

18 Claims, 3 Drawing Sheets

SEAL ASSEMBLY FOR AN OPERABLE PARTITION

BACKGROUND OF THE INVENTION

This invention pertains to operable partitions movable to partition large rooms into smaller rooms, and, in particular, to seal assemblies of operable partitions utilized with carpeted floors that limit noise transmission.

Operable partitions, also known as movable wall panel systems, find useful application in a variety of venues, such as classrooms, offices, convention centers and hospitals. In these venues, the operable partitions can be utilized to efficiently compartmentalize interior space into a multitude of separate, smaller rooms. In order for each one of these separate rooms to provide a useful working environment free from acoustic disturbances, the operable partitions should serve as effective sound barriers to prevent sound created within one room from passing into an adjoining room separated by the partitions.

One path for sound to undesirably pass between adjoining rooms separated by suspended operable partitions is the space between the partitions' lower edges and the floor. To counter this problem, a variety of drop seals have been incorporated into operable partitions. When the operable partitions are aligned to form the movable wall, these drop seals, different types of which include float seals and automated drop seals, project downward below the main panels of the operable partitions and contact the floor. To provide a floor engaging seal with superior sound barrier qualities, these drop seals include one or more floor engaging sealing strips which are intended to provide an air-tight seal with the floor.

A shortcoming of existing drop seals is encountered when the operable partitions are utilized to form a wall over a carpeted floor. In particular, the fabric and construction of the carpet significantly impairs the ability of the drop seal sealing strips to from an air-tight seal with the floor. Consequently, obtaining satisfactory sound barrier qualities between operable partitions and carpeted floor surfaces is more difficult when compared to non-carpeted floor surfaces.

Several ways of addressing this problem have been utilized in the past. For example, frequently the carpet below the operable partition drop seals is removed or omitted and replaced with a strip of smooth material, which is typically wider than the thickness of the operable partitions. The smooth strip is made from a material such as metal, wood, or vinyl to which existing drop seal sealing strips can engage in an adequately air-tight fashion. Although functional, these smooth strips are generally undesirable from an aesthetics standpoint. When the wall panel system is open, these smooth strips noticeably section the carpeted floor and thereby detract from the appearance of the interior space. In another way of addressing the floor sealing problem, sufficiently large forces or pressures are applied to the drop seals such that the underlying carpet contacted by the drop seals is crushed or flattened down. The resulting seal with the carpeted floor is more air-tight than normally achieved with drop seal sealing strips on carpet, and somewhat better sound barrier qualities result, however such a seal is also considered undesirable for many particular installations. For one thing, sound barrier qualities may still be insufficient. Furthermore, the carpet likely retains some of its crushed appearance when the operable partitions are opened, thereby detracting from room aesthetics. Thus, it is desirable to provide a seal which limits the sound passing through the space between operable partitions and a carpeted floor while not destroying the aesthetics of the room in which the operable partitions are installed.

SUMMARY OF THE INVENTION

In one form thereof, the present invention provides an operable partition seal assembly for use with an operable partition movable between an open position and a wall forming position above a strip of carpeted floor, wherein the operable partition when in the wall forming position extends in a first direction, wherein the operable partition includes a drop seal, and wherein the carpeted floor strip includes a carpet layer. The operable partition seal assembly includes a first sealing strip component, attached to an underside of the drop seal, and a second sealing strip component installed in the carpeted floor strip at a location beneath the first sealing strip component when the operable partition is in the wall forming position. The second sealing strip component includes an upwardly extending sealing portion within the carpet layer. The upwardly extending sealing portion includes a crest for sealingly engaging the first sealing strip component to provide a sound barrier seal. The crest includes a length extending in the first direction and a width which is less than the thickness of the drop seal.

In another form thereof, the present invention provides an operable partition seal assembly for use with an operable partition movable between an open position and a wall forming position above a strip of carpeted floor, wherein the operable partition when in the wall forming position extends in a first direction, wherein the operable partition includes a vertical expansion seal, and wherein the carpeted floor strip includes a flooring layer beneath a carpet layer. The operable partition seal assembly includes a first sealing strip component, attached to an underside of the vertical expansion seal and having a length extending in the first direction, and a second sealing strip component, which is installed in the carpeted floor strip at a location beneath the first sealing strip component when the operable partition is in the wall forming position. The second sealing strip component includes an upwardly extending sealing means within the carpet layer for sealingly engaging the first sealing strip component to provide a sound barrier seal. The second sealing strip component also includes means for retaining the upwardly extending sealing means in an operational alignment. The retaining means extends laterally from the upwardly extending sealing means and is insertable underneath the carpet layer.

In still another form thereof, the present invention provides an operable partition seal assembly for use with an operable partition movable between an open position and a wall forming position above a strip of carpeted floor including a carpet layer, wherein the operable partition includes a drop seal. The operable partition seal assembly includes a means for mounting a sealing strip to the drop seal, and the mounting means has at least one downwardly extending carpet engaging prong. The operable partition seal assembly also includes a downwardly facing first sealing strip component, which is attached to the mounting means, and a second sealing strip component, which is installed in the carpeted floor strip at a location beneath the downwardly facing first sealing strip component when the operable partition is disposed in the wall forming position. The second sealing strip component includes an upwardly extending sealing portion within the carpet layer for sealingly engaging the first sealing strip component to provide a sound barrier seal. The second sealing strip component also includes means for retaining the sealing portion in an operational alignment.

An advantage of the seal assembly of the present invention is that the undesirable transmission of sound or noise between partitioned, carpeted rooms can be reduced. Another advantage of the present invention is that the seal assembly uses a relatively thin and inconspicuous sealing component within the carpeted floor so as to be functional without appreciably detracting from the aesthetics of the carpeted room in which it is installed.

BRIEF DESCRIPTION OF THE DRAWINGS

The above mentioned and other advantages and objects of this invention, and the manner of attaining them, will become more apparent and the invention itself will be better understood by reference to the following description of an embodiment of the invention taken in conjunction with the accompanying drawings, wherein.

Figure 1:
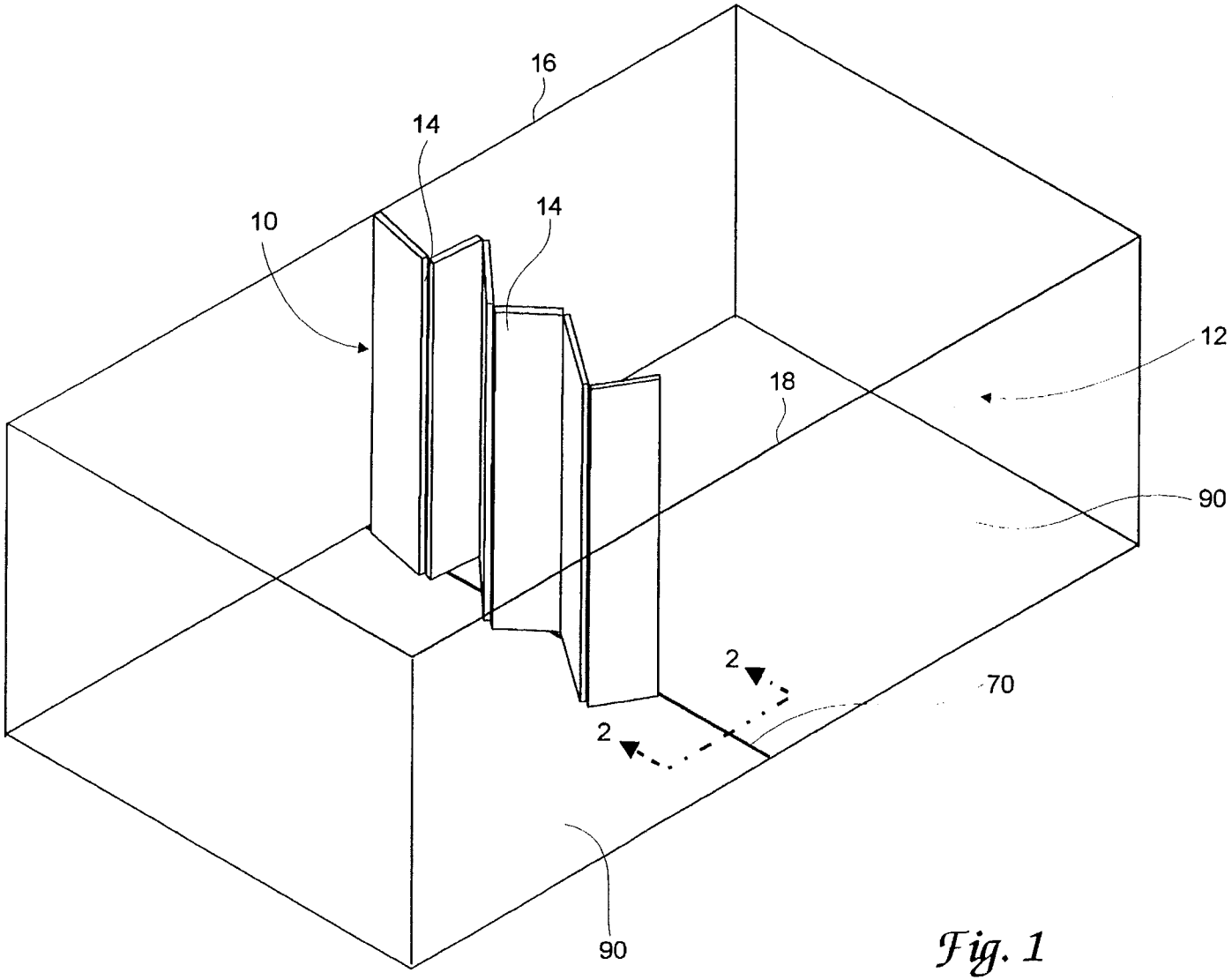
FIG. 1 is a diagrammatic, perspective view of a room and representative operable partition system equipped with the upper seal strip of the seal assembly invention, wherein the seam seal strip of the seal assembly of the present invention has been exaggerated so as to be readily visible as installed within the room floor carpet.

Corresponding reference characters indicate corresponding parts throughout the several views. Although the drawings represent an embodiment of the invention, the drawings are not necessarily to scale and certain features may be exaggerated in order to better illustrate and explain the present invention. The exemplification set out herein illustrates one preferred embodiment of the invention, in one form, and such exemplification is not to be construed as limiting the scope of the invention in any manner.

DESCRIPTION OF THE PREFERRED EMBODIMENT

Referring to FIG. 1, there is shown a diagrammatic perspective view of a moveable wall panel system, generally designated 10, installed in a large, carpeted room or compartment 12. As is conventional, movable wall panel system 10 is suspended from and guided by an overhead track (not shown) mounted in the ceiling of room 12. Moveable wall panel system 10 includes a number of operable partitions 14, which can be, for example, either continuously-hinged as shown or separately movable without detracting from the operation of the invention. Shown at an intermediate stage of movement, wall panel system 10 can be moved between a stacked, open position to an extended, closed position as is well known in the art. When in the closed position, partitions 14 are longitudinally aligned and secured to form a temporary wall connecting rigid room walls 16, 18, thereby compartmentalizing large room 12 into two smaller rooms.

Figure 2:
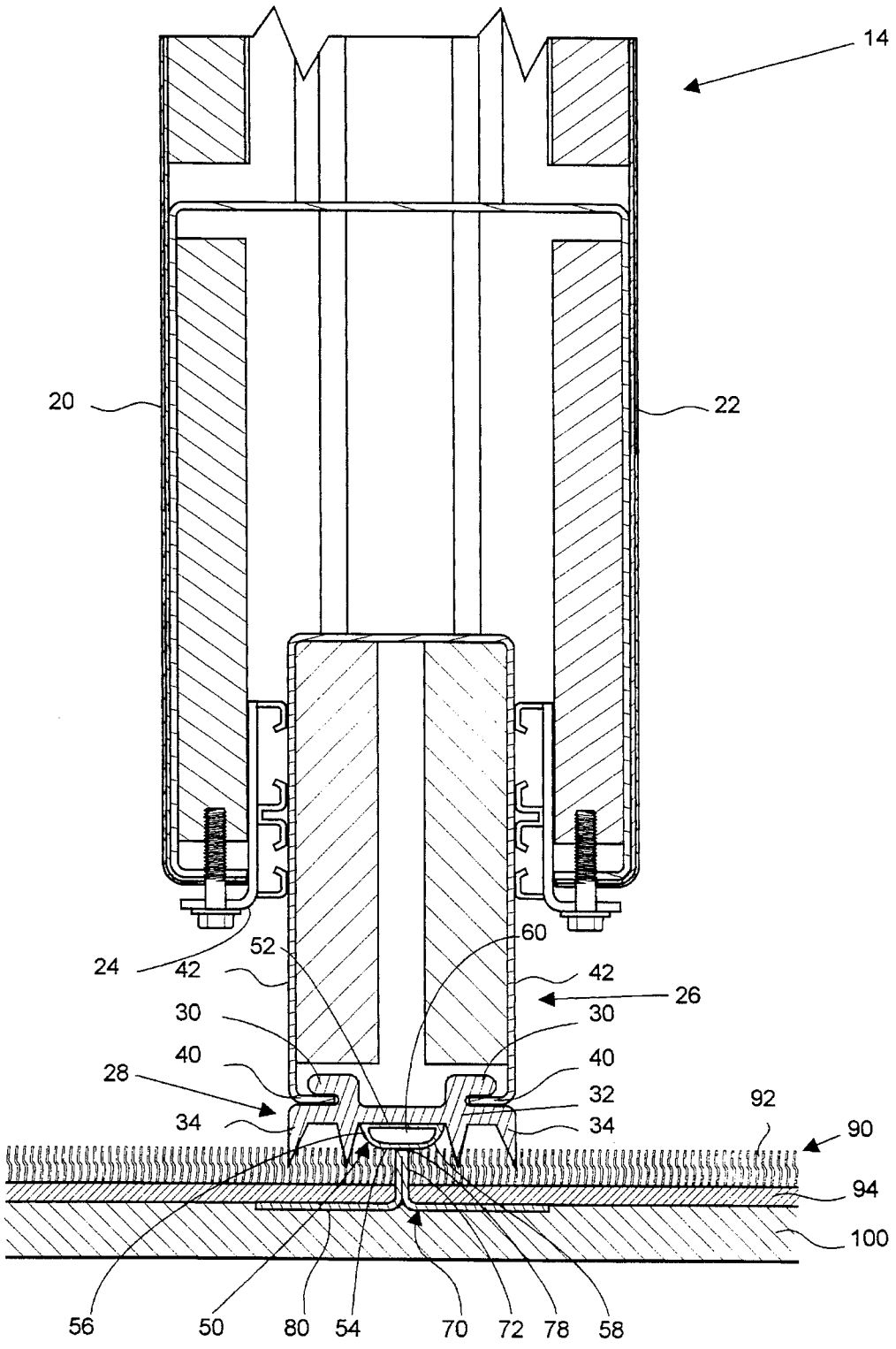
FIG. 2 is cross-sectional view, conceptually taken along the line 2—2 of FIG. 1, of the lower region of an operable partition and the seal assembly when the operable partition is disposed in a wall forming alignment.

Referring now to FIG. 2, there is shown a cross sectional view, conceptually taken along line 2—2 of FIG. 1, of the bottom portion of an operable partition 14 when wall system 10 has been arranged in its closed, wall-forming position. Operable partition 14 includes panel sides 20, 22, defining a wall thickness therebetween, and a panel lower edge 24. Operable partition 14 is shown including an automated drop seal, generally designated 26, which projects below lower edge 24 and extends the entire wall-forming length of partition 14. Assorted aspects of the drop seal 26 shown in FIG. 2, such as the mechanism for moving drop seal 26 between a raised position, substantially recessed within the panel body of operable partition 14, and a lowered operational position, are further described in co-pending application Ser. No. 08/027,376, which is incorporated herein by reference. Furthermore, as various types of vertical expansion seals which span the distance between the floor and the operable partition may be used in conjunction with the seal assembly of the present invention, explanation herein regarding the overall form of drop seal 26 is not intended to be limiting, but rather is provided to best teach the present invention.

Drop seal 26 includes at its underside a seal mounting extrusion 28. The cross-section of extrusion 28 shown is representative of its cross-section along the entire length of partition 14. Extrusion 28 includes lipped, upper flanges 30 which extend upwardly from horizontal plate 32. Flanges 30 fit over inwardly extending lower lips 40 of the drop seal side walls 42, thereby attaching extrusion 28 to the bottom of drop seal 26. Downwardly extending triangular prongs or ridges 34 are formed on the underside of plate 32. Prongs 34 project into the fabric or nap 92 of carpet 90 when drop seal 26 is lowered, thereby serving as an additional barrier limiting the passage of sound.

Referring to FIG. 2, the first seal assembly component is an upper seal strip 50 fixedly attached, preferably with an adhesive, to the underside of extrusion plate 32 between the central pair of prongs 34. Upper seal strip 50 is preferably centered on the underside of drop seal 26 as well as on operable partition 14. The shown cross-section of upper seal strip 50 is representative of its cross-section along the entire length of drop seal 26. Alternatively, rather than adhesives, mechanical fasteners could be employed. In the illustrated embodiment, upper seal strip 50 is constructed from a single, flat strip of suitable pliable or rubber-like material such as double coated rubber sheeting used as sweeps in the operable partition industry. The pliability of this material is desirable to assist in providing an air-tight seal along the length of upper seal strip 50, which likely encounters unevenness within the floor. A preferred material for upper seal strip 50 weighs 23.7 ounces per square yard, has a uniform thickness of 0.025 gauge or approximately 1/32 inch, and is available from Aldan Rubber Company of Philadelphia, Pa., as black rubber sweep.

Upper seal strip 50 includes a bulb type seal shape having a top surface 52, a convex bottom sealing surface 54, side surfaces 56, 58 which define the seal width therebetween, and a preferably hollow interior 60. Upper seal strip 50 has a preferred width of between approximately 0.5 and 4.00 inches, and more preferably about one inch. While larger widths for seal 50 may be possible, they may require more force and pressure applied thereto to achieve an air-tight seal. Slightly lesser widths for seal 50 are also feasible from the standpoint of blocking sound, but are typically not favored because of the corresponding lesser chance of a proper alignment and air-tight seal with seam seal strip 70.

The second component of the seal assembly is a seam seal strip, generally designated 70. Seam seal strip 70 cooperates with upper seal strip 50 to form an air-tight seal along the carpeted floor of room 12 beneath operable partitions 14. Seam seal strip 70 is fixedly installed in room 12 within the carpet 90 underneath the wall formed by operable partitions 14. As abstractly represented by line 70 in FIG. 1, seam seal strip 70 preferably extends completely across the width of the room. Gaps or discontinuity along the length of seam seal strip 70 is less favored as it allows sound to essentially pass unobstructed underneath partitions 14. It will be appreciated that the visibility of seam seal strip 70 in FIG. 1 has been exaggerated for purposes of illustration, as seam seal strip 70 may be virtually inconspicuous when installed.

As shown in FIG. 2, seam seal strip 70 is essentially comprised of two operational parts, namely an upwardly extending sealing projection 72 and a base or retaining section made of flanges 80. This cross-section of seam seal strip 70 is representative of its cross-section along its entire length. In a preferred embodiment shown, seam seal strip 70 is made from the same type of flat strip of double coated rubber sheeting used for upper seal strip 50.

Figure 3:
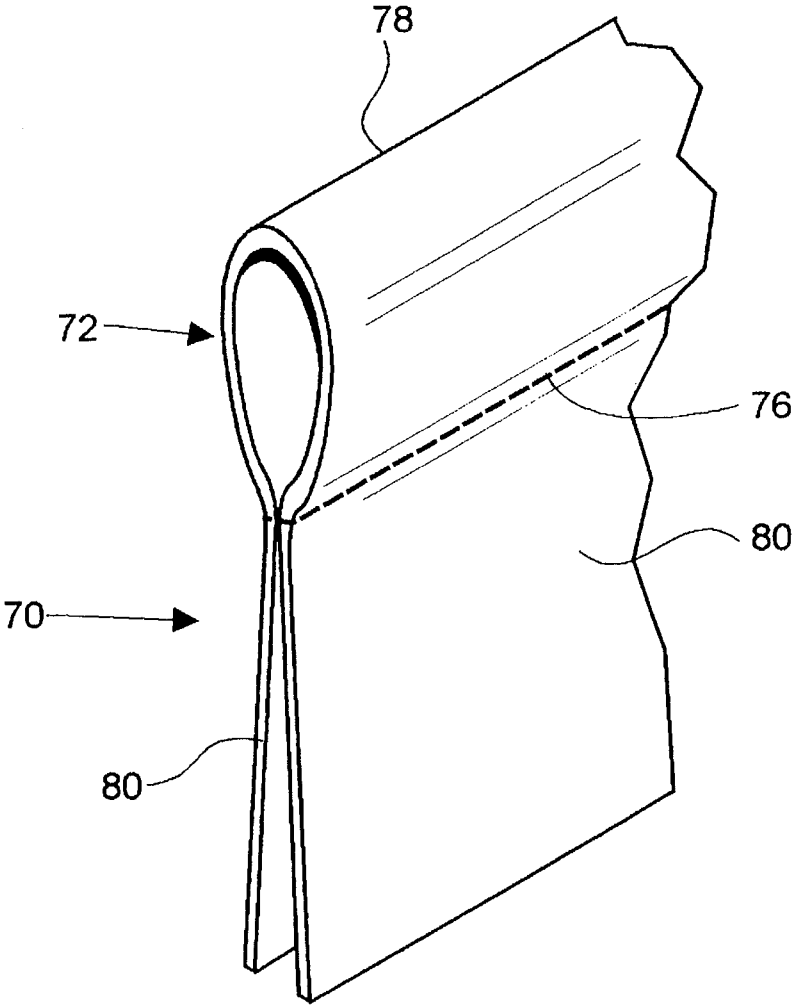
FIG. 3 is an enlarged perspective view of the seam seal strip prior to installation in the room floor carpet.

Referring now to FIG. 3, seam seal strip 70 is shown prior to its insertion into carpet 90 to more clearly illustrate its preferred construction. Sealing projection 72 is formed by doubling over the central region of the flat rubber strip and sewing together the sides along line 76. The resulting shape of sealing projection 72 is that of a hollow bulb type seal with a sealing crest 78 which is at this stage rounded. When inserted within carpet 90 as shown in FIG. 2, the carpet side edges press the sides of sealing projection 72 together, thereby increasing the effective height of sealing projection 72 while maintaining projection 72 in an upright position. The resulting arrangement of installed sealing projection 72 and crest 78 is substantially rectangular in cross-section with a width of around one-sixteenth of an inch. When downward force is applied to projection 72 for example by contact with upper seal strip 50, the sides of projection 72 may bow outward or bend over slightly. The edges of carpet 90, especially the edge portions of rubber backing 94, prevent projection 72 from excessive buckling which might remove it from contact with seal strip 50. The resiliency and crested shape achieved by the bulb seal construction of projection 72 is advantageous in that seam seal strip 70 is less noticeable from a tactile standpoint within carpet 90. For example, projection 72 slightly yields when stepped on by a person within room 12.

When seam seal strip 70 is installed as shown in FIG. 2, sealing projection 72 extends upwardly from below carpet backing 94, within and through nap 92 of carpet layer 90, and ends at the same level as the upper, exposed surface of carpet nap 92. Sealing projection 72 should be centered directly below operable partition 14 to best ensure sealing engagement when drop seal 26 is lowered. Rather than being flush with the top surface of carpet nap 92, crest 78 of sealing projection 72 may be slightly recessed below the top surface of carpet 92, especially if projection 72 is made of a more rigid material. This recessing, for a given nap height, can be accomplished by raising sew line 76 toward the doubled over crest 78. When recessed, sealing projection 72 still functions adequately provided sealing pressure applied to drop seal 26 is sufficiently large to ensure convex bottom sealing surface 54 of upper seal strip 50 is moved into sealing contact with projection 72. Sealing projection 72 could also function to form a sound barrier with upper seal strip 50 if projection 72 protrudes above carpet nap 92. This configuration is not preferred, however, as seam seal 70 would be more conspicuous because persons walking within room 12 would be more likely to both see projection 72 as well as feel it underfoot. It will be appreciated that sealing projection 72 can be colored to blend into the color or design of carpet 90. Moreover, while the preferred width of seam seal projection 72 and its exposed crest 78 is about one-sixteenth of an inch, thinner width projections 72 are possible provided they possess sufficient rigidity to remain in contact with upper seal strip 50 and not buckle out of contact therewith. In addition, larger projection widths, for example up to about 0.25 inch, may be used and are within the scope of the invention. While larger width projections are likely more visible than the preferred embodiment, they are more aesthetically pleasing than many existing carpet sealing solutions.

Seam seal strip 70 also includes side flanges or flaps 80 which originate at sew line 76 where sealing projection 72 terminates. When seam seal strip 70 is installed, flanges 80 are splayed outward and inserted below the opposing edges of carpet 90 and are thereby weighted down by carpet 90. While flanges 80 which are each about one and one-half inches long represent a preferred method of retaining sealing projection 72 in its operational alignment, it will be appreciated that other retaining devices for sealing projection 72 are possible. For example, an operative attachment of projection 72 directly to carpet backing 94 or to flooring 100 may be employed. In addition, flanges 80 may be longer or shorter, or could be formed as a solid piece from which sealing projection 72 perpendicularly extends.

To install seam seal strip 70, carpet layer 90 of the carpeted flooring is sliced completely through down to a typically concrete flooring 100 at a location directly below the wall to be formed. Instead of cutting a unitary piece of carpet, carpet layer 90 could be provided with a seam precisely at this location. Carpet layer 90 on both side of the carpet slice are then lifted up slightly to allow insertion of seam seal strip 70. Flanges 80 are inserted flat onto flooring 100 and below carpet backing 94 on both sides of the carpet slice such that sealing projection 72 is correctly aligned precisely along the slice. No fasteners, such as adhesives or mechanical fasteners, are required between flanges 80 and flooring 100 or carpet backing 94, however fasteners could be employed for an even more secure insertion. Carpet layer 90 is then lowered such that the opposing carpet edges press sealing projection 72 therebetween. Carpet layer 90 may then be further secured to flooring 100.

After seam seal strip 70 is installed, operable partitions 14 with upper seal strip 50 can be effectively utilized. In particular, after partition 14 is moved to its wall forming position directly above and in line with seam seal strip 70, drop seal 26 is forcibly lowered into operational alignment. As drop seal 26 lowers, crest 78 of sealing projection 72 contacts bottom sealing surface 54 of upper seal strip 50 to provide an air-tight, sound barrier seal therebetween. During operation, downwardly directly force is applied to drop seal 26 to ensure a proper seal engagement as well as to stabilize operable partition 14 such that it does not experience side-to-side movement should, for example, a person lean on partition 14. As this pressure is applied, buckling of seam strip seal 70 is limited by the edges of carpet layer 90. Prongs 34 engage carpet nap 92 to further stabilize partition 14 as well as provide additional sound barriers to further limit sound transmission under partition 14.

In alternate embodiments, multiple sealing projections 72 and upper seal strips 50 may be employed. While upper seal strip 50 and seam seal strip 70 are shown as centered relative to operable partition 14, off-centered locations are possible. However, for such constructions, undesirable resonance of sound passing under partition 14 may be encountered.

It will be appreciated by those of skill in the art in view of the operation of the seal assembly that various other materials are suitable for use. For instance, a more rigid material for seam seal strip 70 may allow for an even more narrow sealing projection 72. Such a rigid seam seal strip, however, may be more noticeable underfoot.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. In combination:

a strip of carpeted floor including a carpet layer, said carpet layer including one of a slit and seam defined by facing side edges of said carpet layer;

an operable partition movable between an open position and a wall forming position above the strip of carpeted floor, wherein the operable partition when in the wall forming position extends in a first direction, wherein the operable partition includes a drop seal having a thickness; and an operable partition seal assembly comprising:

a first sealing strip component attached to an underside of the drop seal and having a sealing surface, said first sealing strip component sealing surface including a length extending in the first direction and a width;

a second sealing strip component installed in the carpeted floor strip at a location beneath said first sealing strip component when the operable partition is in the wall forming position, said second sealing strip component comprising an upwardly extending sealing portion within the carpet layer and in contact with said facing side edges of the carpet layer, said upwardly extending sealing portion having a width less than the drop seal thickness, said upwardly extending sealing portion including a crest for sealingly engaging said first sealing strip component sealing surface to provide a sound barrier seal, said crest including a length extending in the first direction and a width, and wherein said width of said sealing portion crest is less than the first sealing strip component sealing surface width.

2. The combination of claim 1 wherein said width of said sealing portion crest is less than about one-quarter inch.

3. The combination of claim 2 wherein said width of said sealing portion crest is about one-sixteenth inch.

4. The combination of claim 2 wherein said upwardly extending sealing portion comprises a bulb seal construction, and wherein said bulb seal is compressable by the contact with said facing side edges of the carpet layer.

5. The combination of claim 2 wherein said upwardly extending sealing portion comprises a pliable material.

6. The combination of claim 2 wherein said second sealing strip component further comprises at least one flange connected to said upwardly extending sealing portion, wherein the carpeted floor strip includes a flooring layer beneath the carpet layer, and wherein said flange is insertable between the carpet layer and the flooring layer to retain said sealing portion in an operational alignment.

7. The combination of claim 6 wherein said at least one flange comprises a pair of flanges, each of said flanges insertable between the carpet layer and the flooring layer on an opposite side of said upwardly extending sealing portion.

8. The combination of claim 2 further comprising means for mounting the first sealing strip component to the drop seal, said mounting means comprising at least one downwardly extending carpet engaging prong.

9. The combination of claim 2 wherein said sealing portion comprises a height whereby said sealing portion crest is substantially level with an upper surface of the carpet layer.

10. The combination of claim 2 wherein said sealing portion comprises a height whereby said sealing portion crest is recessed below an upper surface of the carpet layer.

11. In combination:

a strip of carpeted floor, wherein the carpeted floor strip includes a flooring layer beneath a carpet layer;

an operable partition movable between an open position and a wall forming position above the strip of carpeted floor, wherein the operable partition when in the wall forming position extends in a first direction, and wherein the operable partition includes a vertical expansion seal; and an operable partition seal assembly comprising:

a first sealing strip component attached to an underside of the vertical expansion seal and having a length extending in the first direction;

a second sealing strip component installed in the carpeted floor strip at a location beneath said first sealing strip component when the operable partition is in the wall forming position, said second sealing strip component comprising an upwardly extending sealing means within the carpet layer for sealingly engaging said first sealing strip component to provide a sound barrier seal, said second sealing strip component further comprising means for retaining said upwardly extending sealing means in an operational alignment, said retaining means comprising at least one flange extending laterally from said upwardly extending sealing means and insertable substantially flat between the flooring layer and the carpet layer.

12. The combination of claim 11 further comprising means for mounting the first sealing strip component to the vertical expansion seal, said mounting means comprising at least one downwardly extending carpet engaging prong.

13. The combination of claim 11 wherein said upwardly extending sealing means comprises a sealing portion including a crest for sealingly engaging said first sealing strip component to provide the sound barrier seal, said crest including a length extending in the first direction and a transverse width, and wherein said width of said crest is less than about one-quarter inch.

14. The combination of claim 13 wherein the vertical elevation of the sealing portion crest is substantially level with an upper surface of the carpet layer.

15. In combination:

a strip of carpeted floor including a carpet layer;

an operable partition movable between an open position and a wall forming position above the strip of carpeted floor, wherein the operable partition includes a drop seal vertically shiftable between a raised position and a lowered position; and an operable partition seal assembly comprising:

means for mounting a sealing strip to the drop seal, said mounting means comprising at least one downwardly extending carpet engaging prong, said at least one prong structured to project into said carpet layer to limit sound passage when said drop seal is disposed in said lowered position;

a downwardly facing first sealing strip component attached to said mounting means; and a second sealing strip component installed in the carpeted floor strip at a location beneath the downwardly facing first sealing strip component when the operable partition is disposed in the wall forming position, said second sealing strip component comprising an upwardly extending sealing portion within the carpet layer for sealingly engaging said first sealing strip component to provide a sound barrier seal, said second sealing strip component further comprising means for retaining said sealing portion in an operational alignment.

16. The combination of claim 15 wherein said at least one downwardly extending carpet engaging prong projects downward to a first elevation, and wherein said first sealing strip component includes a bottom surface disposed at a second elevation higher than said first elevation.

17. The combination of claim 15 wherein said upwardly extending sealing portion includes a crest for sealingly engaging said first sealing strip component to provide the sound barrier seal, said crest including a width of less than about one-quarter inch.

18. The combination of claim 15 wherein said retaining means comprises at least one flange connected to said upwardly extending sealing portion, wherein said flange is insertable between the carpet layer and a flooring layer of the carpeted floor strip.

* * * * *